US006910516B2

(12) United States Patent
Huang

(10) Patent No.: US 6,910,516 B2
(45) Date of Patent: Jun. 28, 2005

(54) CURTAIN BLIND TAKE-UP DRIVE MECHANISM WITH NON-SLIP EFFECT

(76) Inventor: Shien-Te Huang, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/661,628

(22) Filed: Sep. 15, 2003

(65) Prior Publication Data

US 2005/0056383 A1 Mar. 17, 2005

(51) Int. Cl.[7] ..... E06B 9/30

(52) U.S. Cl. ..... 160/170; 160/176.1 R; 160/178.1 R; 160/168.1 R

(58) Field of Search ..... 160/170, 168.1 R, 160/177 R, 178.1 R, 178.2 R, 176.1 R, 188, 160/189, 900

(56) References Cited

U.S. PATENT DOCUMENTS 4,487,243 A * 12/1984 Debs ..... 160/168.1 R
4,676,292 A * 6/1987 Valle et al. ..... 160/176.1 R
4,773,464 A * 9/1988 Kobayashi ..... 160/168.1 P
5,092,387 A * 3/1992 King et al. ..... 160/176.1 R
5,553,649 A * 9/1996 Chisaka et al. ..... 160/168.1 R
5,603,371 A * 2/1997 Gregg ..... 160/176.1 P
5,749,405 A * 5/1998 Huang ..... 160/168.1 R
6,379,276 B1 * 4/2002 Cheng ..... 475/4
6,425,432 B1 * 7/2002 Gross et al. ..... 160/176.1 R

* cited by examiner

*Primary Examiner*—Bruce A. Lev
(74) *Attorney, Agent, or Firm*—Troxell Law Office, PLLC

(57) ABSTRACT

A curtain blind take-up drive mechanism with non-slip effect having a freehand turn operation. The non-slip effect is configured to prevent slats of the blind from slipping down, and further includes coupling a power end of a drive shaft to a reel. The drive shaft connects to a worm gear via a transmission amplifier. The worm gear is actuated through reciprocally engaging with a worm driven via a flexible shaft coupling and through operation of a slat tilt rod. Reciprocal teeth meshing and teeth surface pressure between the worm gear and the worm achieves a high slip-rate, and thereby inhibits reverse transmission, thus accomplishing a reverse direction stoppage effect, and further producing a large frictional force and forming a surface-pressure slip effect thereof. The transmission amplifier allows the drive shaft to achieve a high rotational speed, thereby facilitating freehand operation for taking-up and letting-down of the slats.

9 Claims, 8 Drawing Sheets

CURTAIN BLIND TAKE-UP DRIVE MECHANISM WITH NON-SLIP EFFECT

BACKGROUND OF THE INVENTION (a) Field of the Invention

The present invention relates to curtain blinds, and more particularly to a curtain blind take-up drive mechanism with non-slip effect, providing freehand turn operation. The non-slip effect is further configured to prevent slats of the blind from slipping down under their own weight.

(b) Description of the Prior Art

Referring to FIG. 1, which shows a schematic view of a Venetian blind, including a head rail 1 lengthwise configured with a drive shaft 14 therein. A reel 15 is respectively attached to both right and left ends of the drive shaft 14. A power end is actuated through any transmission of a turntable drive unit 12. Indirect operation of a lift cord 130 actuates the reels 15, and thereof reel cords 16 are enabled to take-up or let-down slats 11. Upon a plurality of the salts 11 of a prior Venetian blind coming together, the slats 11 thereupon form a specific synergistic weight with proportional downward gravitational pull. The gravitational pull accordingly pulls on the reels 15 via the reel cords 16 causing the drive shaft 14 to reversibly rotate thereof, and the turntable drive unit 12 correspondingly begins idle running. Consequently the slats 11 slip down and open up.

In order to counteract the aforementioned shortcomings, a conventional blind includes related positioning of components of the turntable drive unit 12, and is additionally configured with resilient tensile components, and therewith utilizing a great variety of designs to achieve a non-slip stoppage component effect, such as resilience or unilaterality of a ratchet to clasp components, whereby a stoppage mechanism is formed. However, the aforesaid non-slip mechanisms are ineffective, for instance, resilience under certain conditions or undulations of indeterminate external forces will likewise cause the slats to slip downwards. Moreover, design of a unilateral ratchet clasp requires a frictional force to actuate a holding mechanism, and because cut-in angles or disparate strength of frictional forces, the frictional force often results in an idling situation arising. Recently, electric motor control has been employed, as well as utilizing electromagnetically controlled electromagnetic clutch methods to achieve a non-slip effect for a take-up and let-down locking control.

The aforementioned non-slip mechanisms are especially suitable when applied to large-scale level slat style curtain units. More importantly, when wind power blows the blind slats, force of traction is produced, and dragging down of the slats results thereof. Furthermore, based on prior art design, whereby a lift cord 130 is employed to operate the take-up and let-down of the blind, the lift cord 130 is designed as a closed loop, whereby a lower section of the loop is a closed end, thereby forming a closed loop. The closed loop of the lift cord 130 can be dangerous to children, whereby when children are playing close to the lift cord 130, the lift cord 130 can wind round the children's limbs and entangles the children thereof.

SUMMARY OF THE INVENTION

Regarding the aforementioned shortcomings, a power end of a drive shaft 14 of the present invention is configured to utilize a gear meshing method between a worm 22 and a worm gear 21, whereupon rotational speed is amplified through a transmission amplifier 4, allowing a reel 15 to achieve an amplified rotational speed when taking-up the slats, and thereby facilitating freehand operation of a slat tilt rod 13. A design objective of the present invention is to produce a return force actuated by teeth meshing and teeth surface pressure between the worm gear 21 and the worm 22, and forming thereof a radial designated effect on the worm gear 21, thereby achieving a non-slip effect, facilitating freehand operation and preventing danger from a lift cord of the prior art as described above.

Another objective of the present invention is to configure the transmission amplifier to utilize a satellite gear unit, wherewith achieving transmission of a greater efficiency.

A third objective of the present invention is to configure the transmission amplifier to utilize an inner-gear meshing configuration, which provides a design that is simple, easy and facilitating structurally change.

A fourth objective of the present invention is to configure the transmission amplifier to utilize a combinatory configuration of meshing gears to facilitate selectivity in transmission variation.

To enable a further understanding of the said objectives and the technological methods of the invention herein, the brief description of the drawings below is followed by the detailed description of the preferred embodiments.

BRIEF DESCRIPTION OF THE DRAWINGS

FIG. 2-1 shows a cross sectional view of a preferred embodiment according to the present invention.

DETAILED DESCRIPTION OF THE PREFERRED EMBODIMENTS

Figure 1:
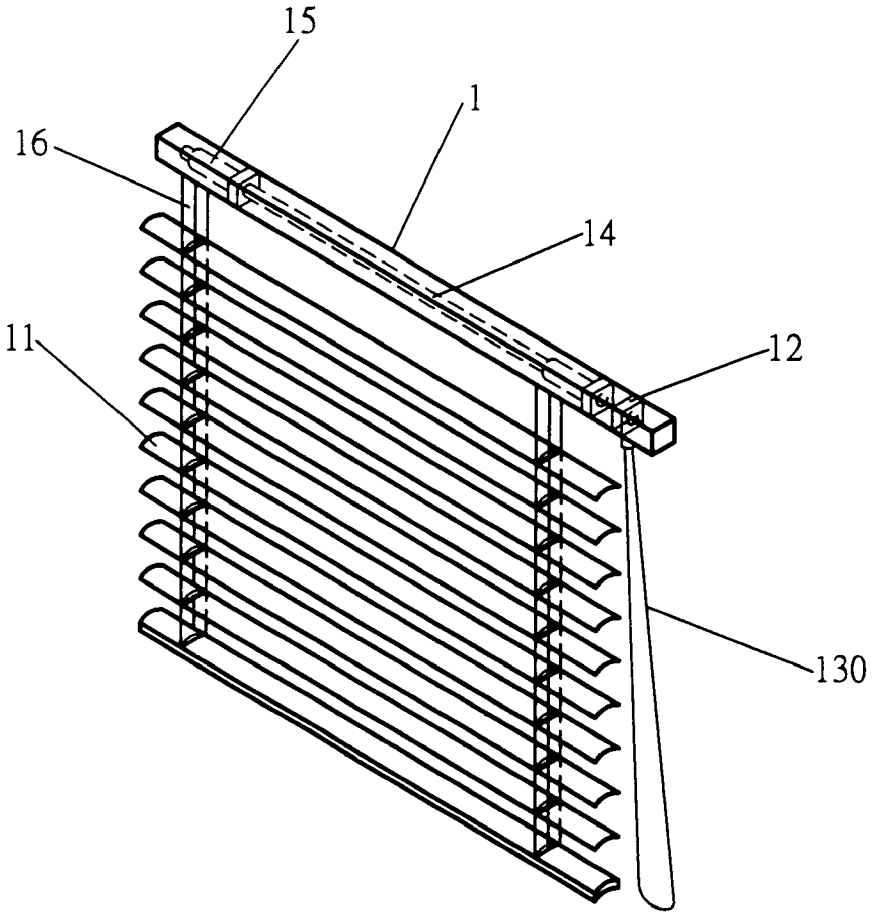
FIG. 1 Prior Art
FIG. 1 shows a schematic drawing of a Venetian blind of the prior art.
Figure 2:
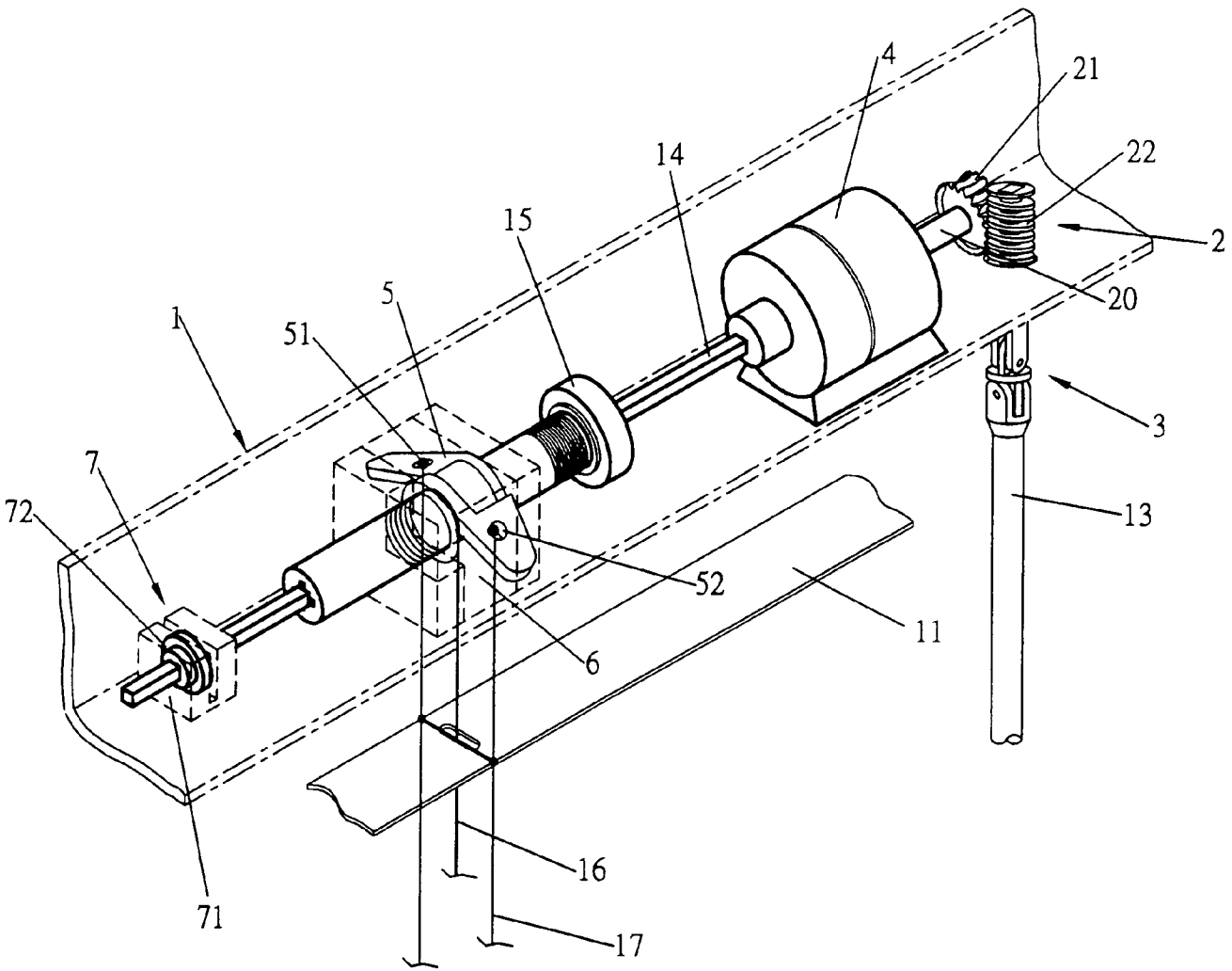
FIG. 2 shows an elevational view of a preferred embodiment according to the present invention.
Figures 1, 2:
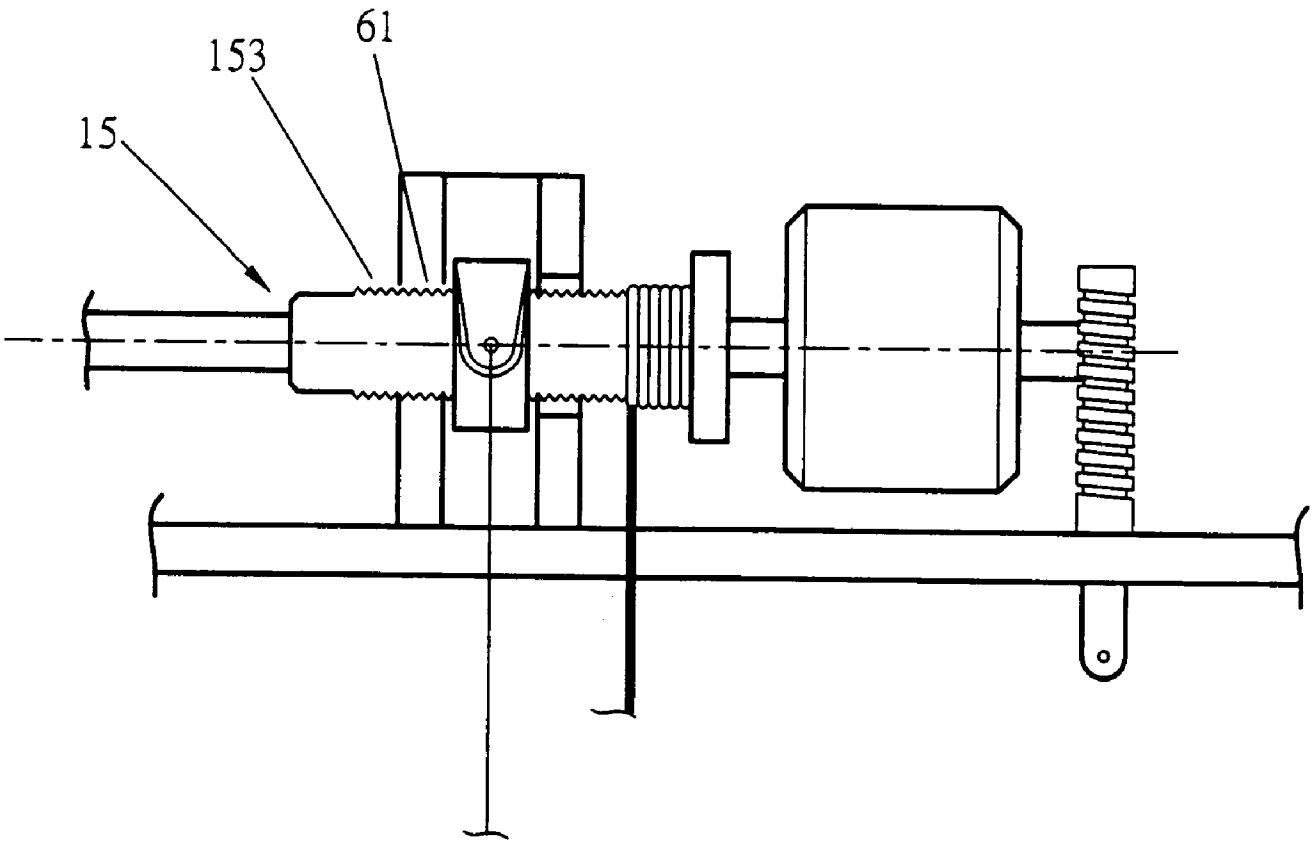

Referring to FIGS. 2 and 2-1, which show a non-slip mechanism of the present invention comprising a worm gear unit 2 that avails the service of a transmission amplifier 4 to achieve high speed taking-up of slats 11, and utilizes a high rotational slippage between a worm gear 21 and a worm 22 to actuate meshing of surfaces of gear teeth and thereof a reverse direction stoppage surface pressure, thereby producing a reverse direction stoppage effect, and achieving the objective of averting the slats 11 from slipping down under their own weight or from external forces.

An operating end comprises a design employing a slat tilt rod 13, the slat tilt rod 13 is adapted to accomplish a safety objective, whereby usage of a pull cord in prior art designs can result in entangling with limbs and thereof resulting in a dangerous situation arising.

A primary configuration of the present invention comprises a drive shaft 14 configured lengthwise within a head rail 1. The drive shaft 14 is freely secured in a support seat 6, and a reversing wing 5 is further configured in the support seat 6, with two extreme ends 51 and 52 of the reversing wing 5 separately connected to a T-cord 17, and thereby adapted to have a drive-reversing-effect on the slats 11.

The T-cord 17 manipulates the slats 11, thereby enabling adjustment of angle of tilt of the slats 11, and regulating angle of light reflection thereof. The reversing wing 5 is mounted on an outer cylinder of a cord-retracting reel 15, and adapted to having sliding friction effect, whereby the reversing wing 5 rotates in reciprocal relation to rotating of the reel 15, and thereupon actuates the T-cord 17, whereupon angle of tilt of the slats 11 are adjusted to regulate angle of light reflection. Upon completing adjustment of the slats 11, if the reel 15 continues to rotate in the same direction (that is, the reel 15 proceeds to lift the slats 11 upwards), the reversing wing 5 will thereupon self-separate from the constricting frictional force of the outer cylinder of the reel 15, allowing the reel 15 to free itself therefrom and freely rotate, and thus facilitate taking-up of the slats 11. Design is of the prior art, and thus herein does not go into further details.

A working end of a drive shaft 14 comprises a reel 15, and the reel 15 is configured to be radially rotated. Furthermore, the reel 15 is rotatably positioned on a screw thread portion 61 defined on the support seat 6, and an outer screw thread 153 screws onto the screw thread portion 61. Upon the reel 15 rotating, because the reel 15 is screwed onto the support seat 6, the reel 15 is transversely displaced along the support seat 6 (see FIG. 2-1). If the reel 15 rotatably recedes in a right direction, it can be seen that operational displacement of the slats 11 results in letting-down of the slats 11.

A stop-push device 7 is configured on one section of the drive shaft 14 unit. The stop-push device 7 is secured within a mounting unit 71 disposed in the head rail 1 and connected with a standard coupling to a stop-push plate 72 of the drive shaft 14, whereby the stop-push plate 72 receives cut-off pressure from the mounting unit 71, thereupon ensuring the drive shaft 14 does not move lengthwise.

The cord-retracting reel 15 provides winding and unwinding thereon of the reel cord 16 according to whether the slats 11 are being taken up or let down. A power end of the drive shaft 14 is actuated indirectly through the transmission amplifier 4 that connects to a drive shaft 20 and thereon coupling with the worm gear 21 of the worm gear unit 2. The worm gear 21 meshes with teeth of the worm 22, and the worm 22 is connected to a flexible shaft coupling 3, and thereon lower down connects to a hand-operated slat tilt rod 13, whereby the flexible shaft coupling 3' forms a universal polyhedral jointed transmission that facilitates the slat tilt cord 13 actuating the worm 22 from any relative angle thereof. Upon the worm 22 being actuated by the slat tilt cord 13, meshing occurs between the worm 20 and the worm gear 21, whereupon power from the worm gear 21 is transmitted to the coupling drive shaft 20 and thereon to the transmission amplifier 4, whereupon functionality of amplifying rotational speed of the transmission amplifier 4 is employed to achieve an amplification of rotational speed of the driven drive shaft 14, correspondingly providing the reel 15 the facility to hasten taking-up and letting-down of the slats 11.

Under a situation whereby the slats 11 have been taken up half-way or upon being completely taken up, because the slats 11 themselves possess a given weight, a slipping down effect under their own weight is produced, or because of influence from external forces, whereupon a pull-effect is affected on the reel cord 16 that is transmitted to the reel 15, and produces rotation of the drive shaft 14. After indirect transmission through the transmission amplifier 4, a larger torque is produced that actuates rotation of the coupling drive shaft 20, and the worm gear 21 connected to the coupling drive shaft 20 thereon meshes side-on with teeth of the worm 22, and produces a teeth surface pressure stoppage effect from reciprocal meshing of teeth surfaces between the worm gear 21 and the worm 22, achieving a non-slip effect therefrom.

Figure 4:
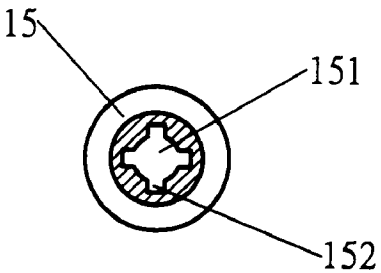
FIG. 4 shows a cutaway end view of the reel shaft according to the present invention.
Figure 3:
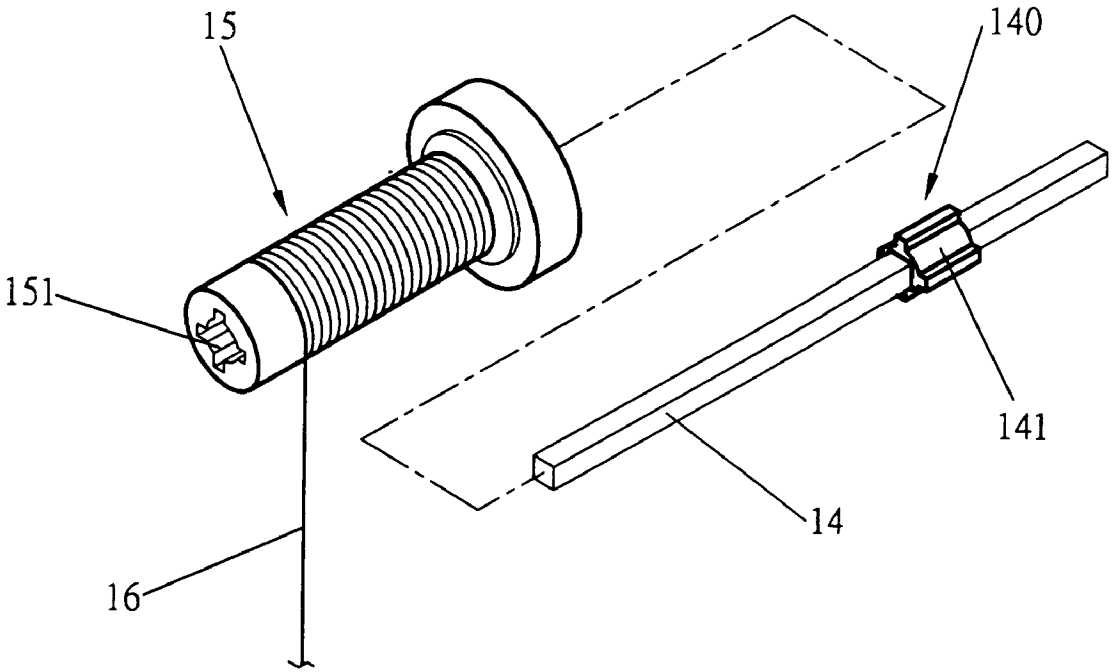
FIG. 3 shows an elevational view of the drive shaft and reel mechanism according to the present invention.

Referring to FIGS. 3 and 4, which show interactive relationships between the reel 15 and the drive shaft 14. The reel 15 provides winding thereon of the reel cord 16, a though hole 151 is adapted to affect radial meshing with the drive shaft 14. Because vertical positioning of the reel cord 16 is fixed, thus in the process of taking up the slats 11, the reel 15 and the drive shaft 14 form a lengthwise relative displacement, whereas movement positioning of the drive shaft 14 and the reel cord 16 are both fixed, and lengthwise displacement is produced by the reel 15, therefore the through hole 151 is seen to make a lengthwise slip motion on the drive shaft 14. In order to reduce friction between inside of the through hole 151 of the reel 15 and the drive shaft 14, a cut-off block 140 is configured to engage between the drive shaft 14 and the through hole 151, a slide piece 141 is radially configured on the cut-off block 140, whereby the cut-off block 140 engages with the cut-off groove 152 defined within the through hole 151 of the reel 15, and slippage between the slide piece 141 and the cut-off groove 152 operate in coordination to form a relatively small surface area friction, and radial support facilitates reducing radial frictional force when the reel 15 is rotating.

Figure 5:
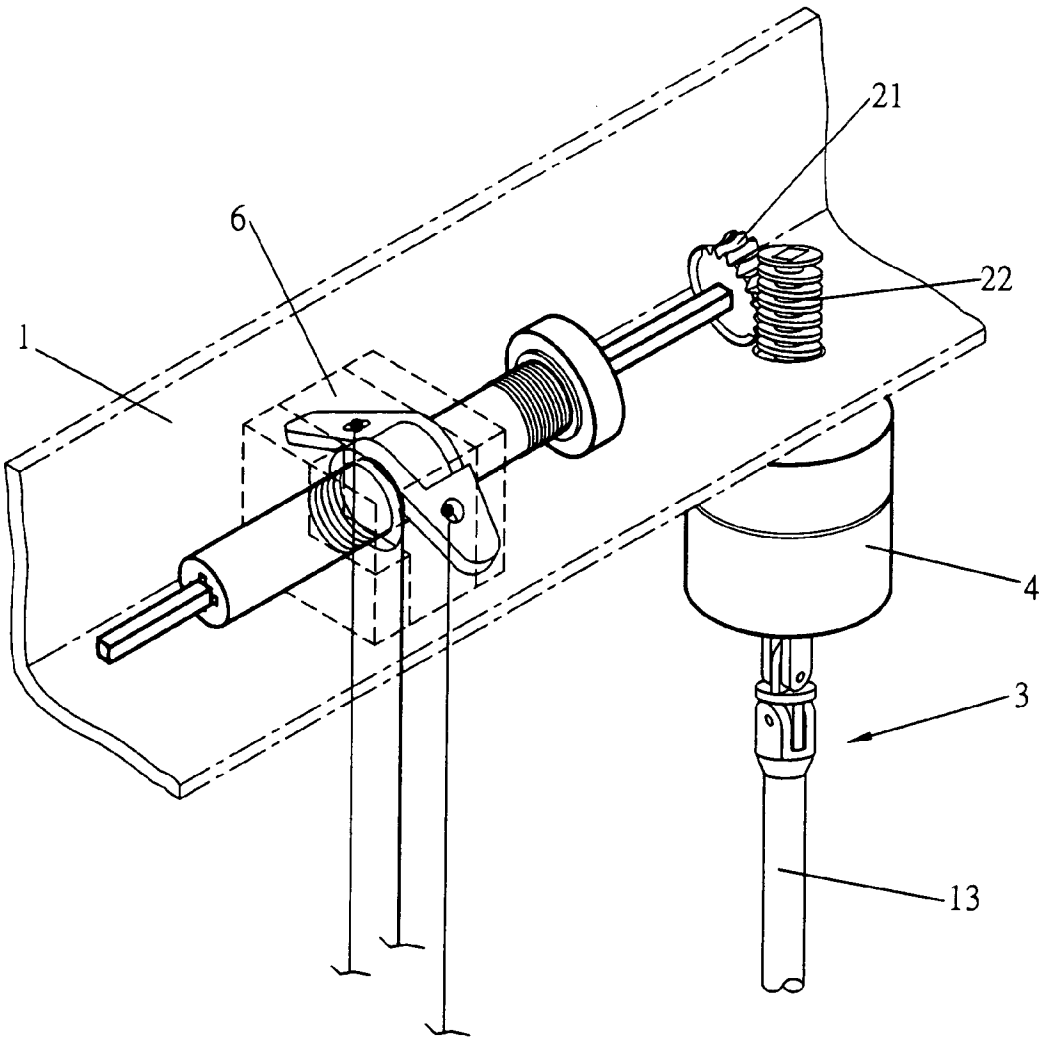
FIG. 5 shows an elevational view of another preferred embodiment according to the present invention.

Referring to FIG. 5, which shows an embodiment of the present invention, apart from a configuration of the transmission amplifier 4 as depicted in FIG. 2, the transmission amplifier 4 can further be configured between the worm 22 and the slat tilt rod 13 (see FIG. 5). An upper portion of the slat tilt rod 13 is coupled to the flexible coupling shaft 3, which thereon connects to the transmission amplifier 4. A power end of the transmission amplifier 4 actuates the worm 22, providing the worm 22 with an amplified rotational speed, and thereon meshing with the worm gear 21. The transmission amplifier 4 is securely mounted directly below the head rail 1. Because of the slats 11 rotating in a reverse direction under their own weight, teeth surface pressure between the worm gear 21 and the worm 22 correspondingly produce a stoppage effect of the slipping slats thereof.

Figure 6:
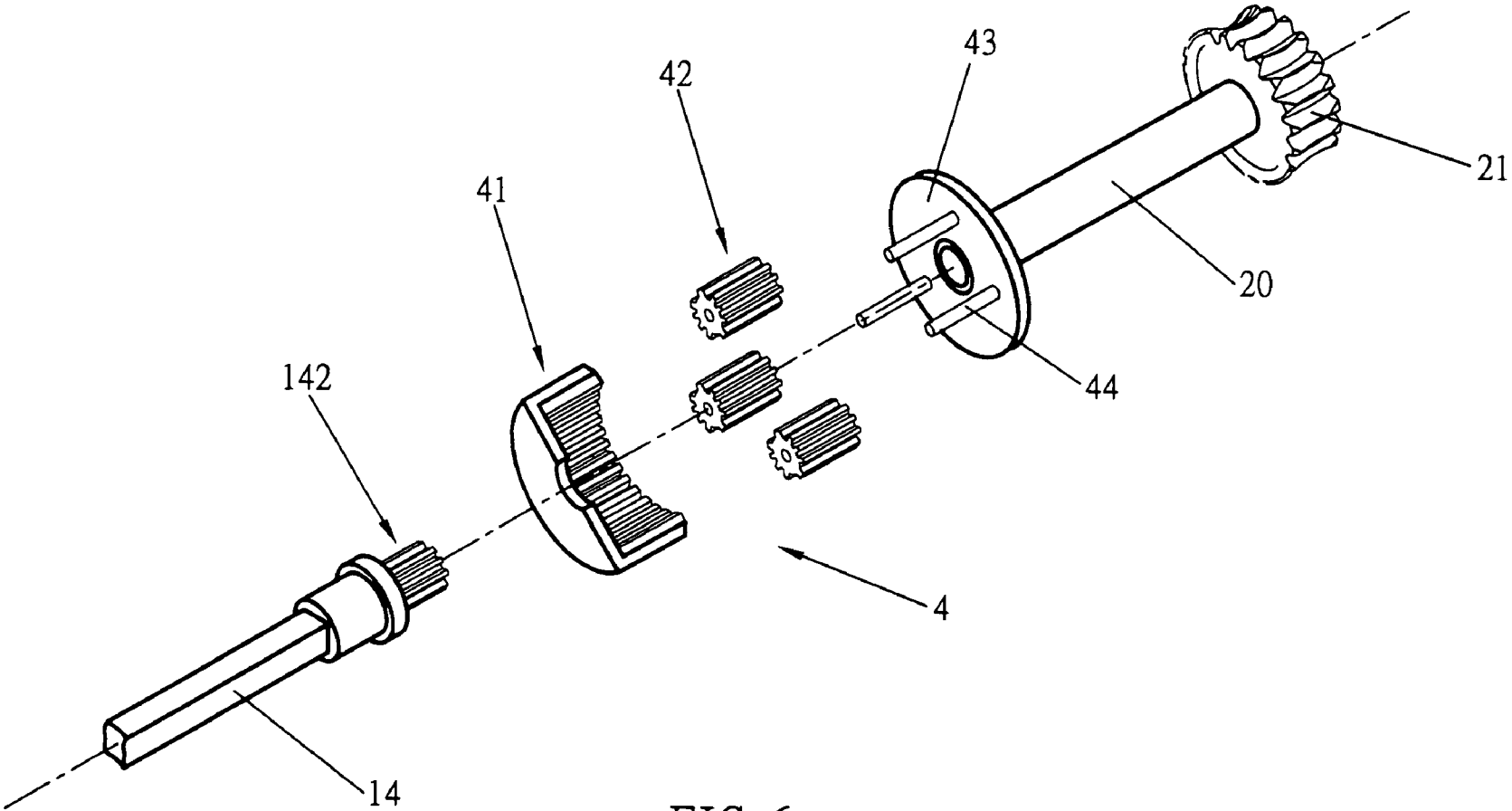
FIG. 6 shows an exploded elevational view of one configuration of the transmission amplifier according to the present invention.

Referring to FIG. 6, which shows a structure of one embodiment of one application of the present invention. Basically, FIG. 6 depicts application of a planetary gear set, whereby a central shaft gear 142 is connected to the drive shaft 14 and acts as a star gear. The central shaft gear 142 engages with satellite gears 42 by means of symmetrically angled meshing thereof. Furthermore, shaft pins 44 are configured on a turntable 43, whereby the shaft pins 44 freely rotatably position the satellite gears 42. The turntable 43 is connected to the coupling drive shaft 20, and another end of the coupling drive shaft 20 connects to the worm gear 21. Upon the worm gear 21 rotating, the worm gear 21 activates the turntable 43, whereupon the shaft pins 44 engage peripherally with the satellite gears 42, and the satellite gears 42 engage with an inner-ring gear 41. During process of rotating meshing of gears, the central shaft gear 142 is actuated thereupon and rotates, whereupon meshing between the satellite gears 42 of smaller diameter and the inner-ring gear 41 of larger diameter affects a synergistic circumferential ratio effect, thereby producing an amplified rotational speed that meshes with the central shaft gear 142, and thereupon is transferred to amplifying rotational speed of the drive shaft 14.

Figure 8:
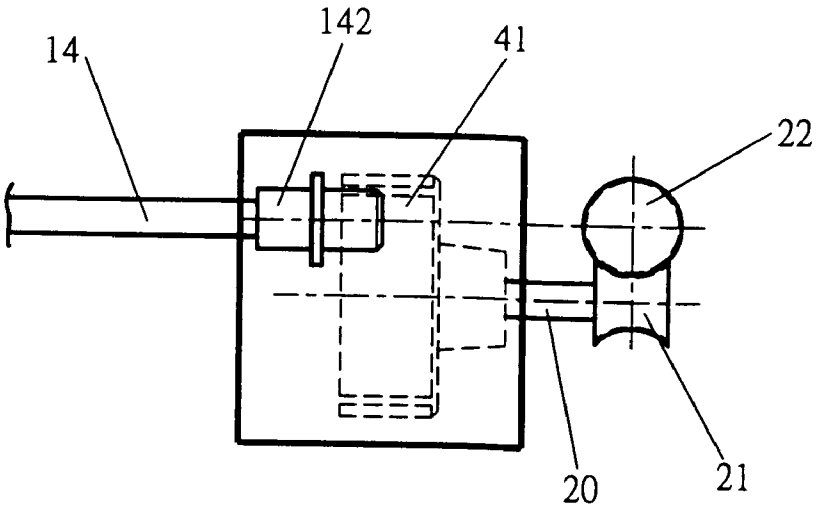
FIG. 8 shows a cross elevational view of FIG. 7 according to the present invention.
Figure 7:
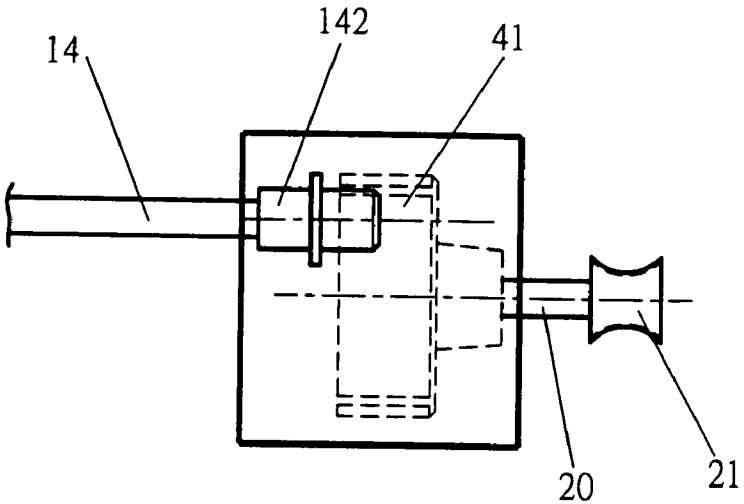
FIG. 7 shows a cross elevational view of another configuration of the transmission amplifier according to the present invention.

An objective of the present invention is advancement in simplification in accordance with structural requirements. As FIGS. 7 and 8 show, the transmission amplifier 4 utilizes a method of bias meshing, whereby the central shaft gear 142 is configured to freely engage with the inner-ring gear 41. The inner-ring gear 41 is coaxially connected to the coupling drive shaft 20, which thereon connects to the worm gear 21. Upon the worm gear 21 rotating, the inner-ring 41 is actuated, and inner teeth of the inner-ring gear 41 mesh with the central shaft gear 142. Because diameter of the inner-ring gear 41 is larger than diameter of the central shaft gear 142, rotational speed is amplified, and thereupon the transmission amplifier 4 amplifies rotational speed of the drive shaft 14.

The present invention facilitates installation placement of the worm 22 (see FIG. 8) in longitudinal alignment with the drive shaft 14. One side of the worm 22 meshes with the worm gear 21, and the worm gear 21 is coupled to the coupling drive shaft 20, which thereon connects to the inner-ring gear 41. The inner-ring gear 41 is adapted to utilize a bias meshing method with the central shaft gear 142, thereby allowing the drive shaft 14 and the worm 22 to be in longitudinal alignment.

Figure 9:
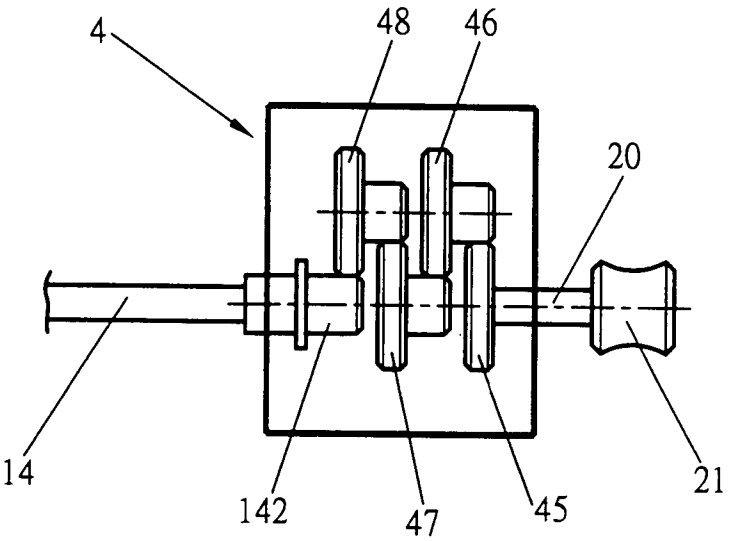
FIG. 9 shows a cross elevational view of yet another configuration of the transmission amplifier according to the present invention.

Referring to FIG. 9, which relates to the present invention achieving advancement in facilitating power requirements, convenience of preparing materials, and selectivity in rotational speed matching installation, whereby the present invention utilizes a simple and easy gear method that employs a multilayer gear configuration within the transmission amplifier 4. The worm gear 21 at a power end of the transmission amplifier 4 is connected to the coupling drive shaft 20, and thereof directly actuates a first gear 45, the first gear 45 actuates a second gear 46, the second gear 46 actuates a third gear 47, and the third gear actuates a fourth gear 48. Lastly, the larger fourth gear 48 engages with the central shaft gear 142, thus forming a multiplying high power amplification, achieving amplification of rotational speed of the drive shaft 14.

Figure 10:
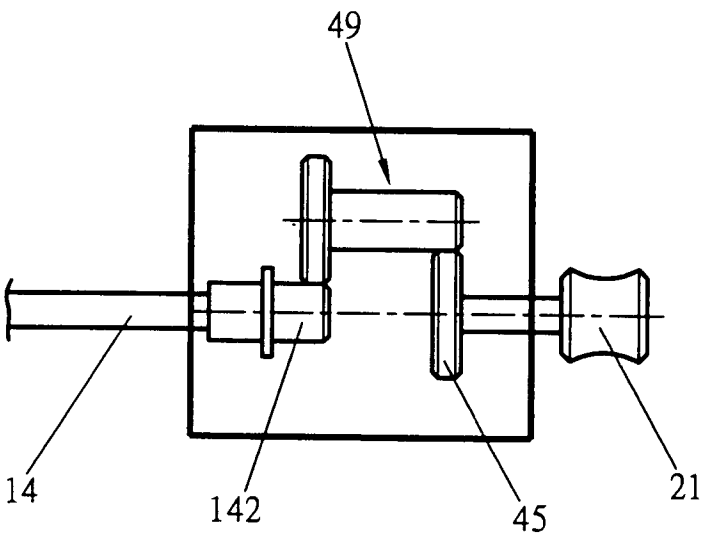
FIG. 10 shows a cross elevational view of FIG. 9 according to the present invention.

Referring to FIG. 10, which shows another configuration to execute amplification of rotational speed. The worm gear 21 engages with the first gear 45, whereon the first gear 45 directly meshes with a bridging gear 49. A larger diameter of the bridging gear 49 meshes with the central shaft gear 142, and amplification of rotational speed of the drive shaft 14 is similarly accomplished. Comparing FIGS. 9 and 10, amplification of rotational speed of FIG. 10 is lower than that of FIG. 9. The lower rotational speed amplification can be utilized in a setting where a load the slats 11 have to bear is relatively light. Gear configuration of the transmission amplifier 4 in FIG. 10 is such that amplification of rotational speed is produced simply from a unitary amplification executed through the bridging gear 49. Whereas FIG. 9 shows a configuration incorporating two additional gears including the second gear 46, and the third gear 47, achieving an enhancement in manyfold amplification of rotational speed. Configuration depicted in FIG. 9 can be employed in a setting where a load the slats have to bear is relatively heavy.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A take-up drive mechanism for a blind comprising:

a) a drive shaft adapted to be rotatably located in a head rail of the blind;

b) a worm gear unit adapted to be located between the drive shaft and a slot tilt rod of the blind;

c) a transmission amplifier adapted to be located between the drive shaft and the slot tilt rod of the blind;

d) a cut-off block having a slide piece extending outwardly on an exterior thereof, the drive shaft being slidably inserted through the cut-off block; and e) a cord retracting reel having:

i) a through hole;

ii) a plurality of cut-off grooves; and iii) an external thread, wherein the cut-off block being inserted into the through hole of the cord retracting reel, the slide piece being inserted into the cut-off grooves, the thread having a reel cord of the blind wound thereon to selectively adjust a height of slats of the blind, the cord retracting reel having a rotation controlled by a rotation of the drive shaft.

2. The according to claim 1, wherein the transmission amplifier is adapted to be located between the worm gear unit and the slot tilt rod of the blind.

3. The according to claim 1, wherein the transmission amplifier is connected to the worm gear unit at a first end by a coupling drive shaft and at a second end to the drive shaft.

4. The according to claim 3, wherein the transmission amplifier includes an inner-ring gear, the drive shaft includes a central shaft gear engaging and driven by the inner-ring gear.

5. The according to claim 3, wherein the transmission amplifier includes an inner-ring gear and a plurality of satellite gears engaging the inner ring-gear, the drive shaft includes a central shaft gear, the coupling drive shaft including a turn table located on an end thereof and a plurality of shaft pins extending from the turn table, each of the plurality of shaft pins is inserted through one of the plurality of satellite gears, the central shaft gear engaging and being driven by the plurality of satellite gears.

6. The according to claim 3, wherein the transmission amplifier includes a first gear, a second gear engaging and driven by the first gear, a third gear engaging and driven by the second gear, a fourth gear engaging and driven by the third gear, and the drive shaft includes a central shaft gear engaging and driven by the fourth gear.

7. The according to claim 3, wherein the transmission amplifier includes a first gear, a bridging gear engaging and driven by the first gear, and the drive shaft includes a central shaft gear engaging and driven by the bridging gear.

8. The according to claim 1, wherein the worm gear unit includes a worm gear and a worm connected to the worm gear.

9. The according to claim 1, further comprising a reversing wing adapted to be connected at each of two opposing ends to one of two T-cords of the blind.

* * * * *